US008511669B2

(12) United States Patent
Koyama

(10) Patent No.: US 8,511,669 B2
(45) Date of Patent: Aug. 20, 2013

(54) SHEET FEEDING APPARATUS AND IMAGE FORMING APPARATUS

(75) Inventor: Fuyuko Koyama, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/272,630

(22) Filed: Oct. 13, 2011

(65) Prior Publication Data

US 2012/0104681 A1 May 3, 2012

(30) Foreign Application Priority Data

Nov. 2, 2010 (JP) ..... 2010-246516

(51) Int. Cl.
*B65H 3/30* (2006.01)

(52) U.S. Cl.
USPC ..... 271/21; 271/123

(58) Field of Classification Search
USPC ..... 271/16, 19, 21, 22, 123, 169
See application file for complete search history.

(56) References Cited

U.S. PATENT DOCUMENTS

| | | | | |
|---|---|---|---|---|
| 4,136,861 | A * | 1/1979 | Goff, Jr. | 271/22 |
| 4,395,034 | A * | 7/1983 | Fukui | 271/21 |
| 4,463,943 | A * | 8/1984 | Deconinck | 271/21 |
| 5,135,213 | A * | 8/1992 | Malachowski et al. | 271/104 |
| 5,785,311 | A * | 7/1998 | Doery | 271/110 |
| 6,488,277 | B2 * | 12/2002 | Herrmann | 271/22 |
| 7,100,913 | B2 * | 9/2006 | Garcia et al. | 271/21 |
| 2005/0067753 | A1 * | 3/2005 | Zahavi | 271/19 |

FOREIGN PATENT DOCUMENTS

| | | |
|---|---|---|
| JP | 5-147752 | 6/1993 |

* cited by examiner

*Primary Examiner* — Jeremy R Severson
(74) *Attorney, Agent, or Firm* — Fitzpatrick, Cella, Harper & Scinto

(57) ABSTRACT

In a sheet feeding apparatus and image forming apparatus of the present invention having stable performance without occurrence of double-feeding and non-feeding regardless of a type of sheet, a sheet holding portion which distorts a sheet as restricting sheet movement in a sheet drawing direction by pressing the upper face of sheets stacked on a bottom plate of a sheet cassette is disposed to the downstream in the sheet drawing direction of a feeding roller which is capable of performing forward and reverse rotation and a sheet holding position by the sheet holding portion is set to be closer to the feeding roller with decrease of sheet stiffness.

8 Claims, 12 Drawing Sheets

SHEET FEEDING APPARATUS AND IMAGE FORMING APPARATUS

BACKGROUND OF THE INVENTION

1. Field of the Invention

The present invention relates to a sheet feeding apparatus, and in particular, relates to a structure in which sheets are separated one by one with forward rotation of a feeding roller after a sheet is drawn with reverse rotation of the feeding roller.

2. Description of the Related Art

An image forming apparatus in the related art such as a printer, a facsimile and a copying machine is provided with a sheet feeding apparatus which feeds sheets stored in a sheet storing portion toward an image forming portion. Here, it is extremely important for such a sheet feeding apparatus to stably feed sheets one by one. Therefore, various methods have been proposed for preventing occurrence of double-feeding to concurrently convey a plurality of sheets such as recording paper.

Recently, printers and facsimiles have been widely spread for home use. Therefore, further miniaturization of an image forming apparatus body (hereinafter called an apparatus body) has been required. Accordingly, in addition to performing stable sheet feeding while preventing double-feeding, miniaturization has been an important issue for a sheet feeding apparatus.

For example, for a sheet feeding apparatus having a sheet cassette on which sheets are stacked, it has been strongly required that depth of the apparatus body does not exceed depth of the sheet cassette.

As a sheet feeding apparatus with apparatus body depth being within sheet cassette depth, for example, Japanese Patent Laid-open No. 5-147752 discloses a structure to convey a sheet in the sheet feeding direction after the sheet is once drawn in the direction opposite to the sheet feeding direction for performing sheet feeding. Here, such a sheet feeding apparatus includes a sheet feeding roller which is capable of performing forward and reverse rotation, a rear wall of a sheet cassette, and a separation claw which is placed at the downstream of the sheet cassette in the sheet feeding direction.

Here, for performing sheet feeding, first, a sheet in the sheet cassette is drawn in the direction opposite to the sheet feeding direction with reverse rotation of the feeding roller. When the sheet is drawn in the direction opposite to the sheet feeding direction as described above, the front end of the uppermost sheet stored in the sheet cassette gets through the separation claw and the rear end of the sheet is pressure-contacted to the rear wall of the sheet cassette. Accordingly, the uppermost sheet is to be distorted having the rear wall as a fulcrum. Then, when the feeding roller performs forward rotation, the drawn uppermost sheet is conveyed as the front end running on the separation claw while being restored from a distorted state. In this manner, only the uppermost sheet is to be fed.

Here, when the feeding roller performs reverse rotation, there is a possibility of occurrence of conveyance and distortion of at least the second sheet positioned below the uppermost sheet to be caused by a friction force with the uppermost sheet. However, since at least the second sheet has a restoring force to restore from the distorted state being larger than the force in the drawing direction received from the feeding roller via the uppermost sheet, the front end of the second sheet is restored owing to the restoring force before the front end of the second sheet gets through the top end of the separation claw. Accordingly, when the feeding roller performs reverse rotation, the uppermost sheet and the second sheet are separated.

In such a sheet feeding apparatus in the related art, the restoring force is applied to the second sheet as described above when the uppermost sheet is distorted as being drawn in the direction opposite to the sheet feeding direction. Here, magnitude of the restoring force varies greatly depending on a type of sheet. In general, even in a condition of the same distortion amount, stiffness becomes low (i.e., rigidity becomes low) and a restoring force becomes small with decrease of thickness of sheets, for example. Accordingly, even if the distortion amount is set to cause restoring by the restoring force for a plain sheet, the front end of the second sheet gets through the separation claw as being distorted along with the uppermost sheet in a case of thin sheets. When the feeding roller is rotated in the sheet feeding direction from this state, there may be a case that the second sheet is fed along with the uppermost sheet to cause double-feeding.

On the other hand, in general, stiffness becomes high (i.e., rigidity becomes high) with increase of thickness of sheets. Here, distortion is unlikely to occur owing to a large restoring force. Accordingly, even if the distortion amount is set to cause restoring by the restoring force for a plain paper, there may be a case, in a case of thick sheets, that the front end of the uppermost sheet cannot get through the separation claw owing to slippage of the feeding roller to cause sheet non-feeding.

As described above, in a case that sheets are separated owing to the restoring force of the second sheet, double-feeding may occur with thin sheets and sheet non-feeding may occur with thick sheets when the distortion amount is constant. That is, in a case of that sheets are separated owing to the restoring force of the second sheet, sheet types (i.e., a range of stiffness) are limited for performing stable feeding.

To address the above issues, the present invention provides a sheet feeding apparatus and an image forming apparatus having stable performance without occurrence of double-feeding and non-feeding regardless of a type of sheet.

SUMMARY OF THE INVENTION a sheet support portion on which sheets are stacked; a separation claw which holds an upper portion of a downstream side end of the sheets stacked on the sheet support portion in a sheet feeding direction; a feeding roller which is capable of performing forward and reverse rotation to feed an uppermost sheet of the sheets stacked on the sheet support portion, an uppermost sheet is drawn from the separation claw with reverse rotation of the feeding roller and the drawn sheet is fed along the upper face of the separation claw with forward rotation of the feeding roller; a sheet holding portion which is moved along a sheet drawing direction of the feeding roller at a downstream in the sheet drawing direction of the feeding roller, and the sheet holding portion presses the upper face of the sheets stacked on the sheet support portion to distort the uppermost sheet by restricting movement of the sheet during drawing the uppermost sheet from the separation claw, and a sheet holding position of the sheet holding portion is set to be closer to the feeding roller with decrease of stiffness of the sheets to be fed.

According to the present invention, since the sheet holding position by the sheet holding portion is set to be closer to the feeding roller with decrease of sheet stiffness, stable sheet feeding can be performed without occurrence of double-feeding and non-feeding regardless of a type of sheet.

Further features of the present invention will become apparent from the following description of exemplary embodiments with reference to the attached drawings.

DESCRIPTION OF THE EMBODIMENTS

Figure 1:
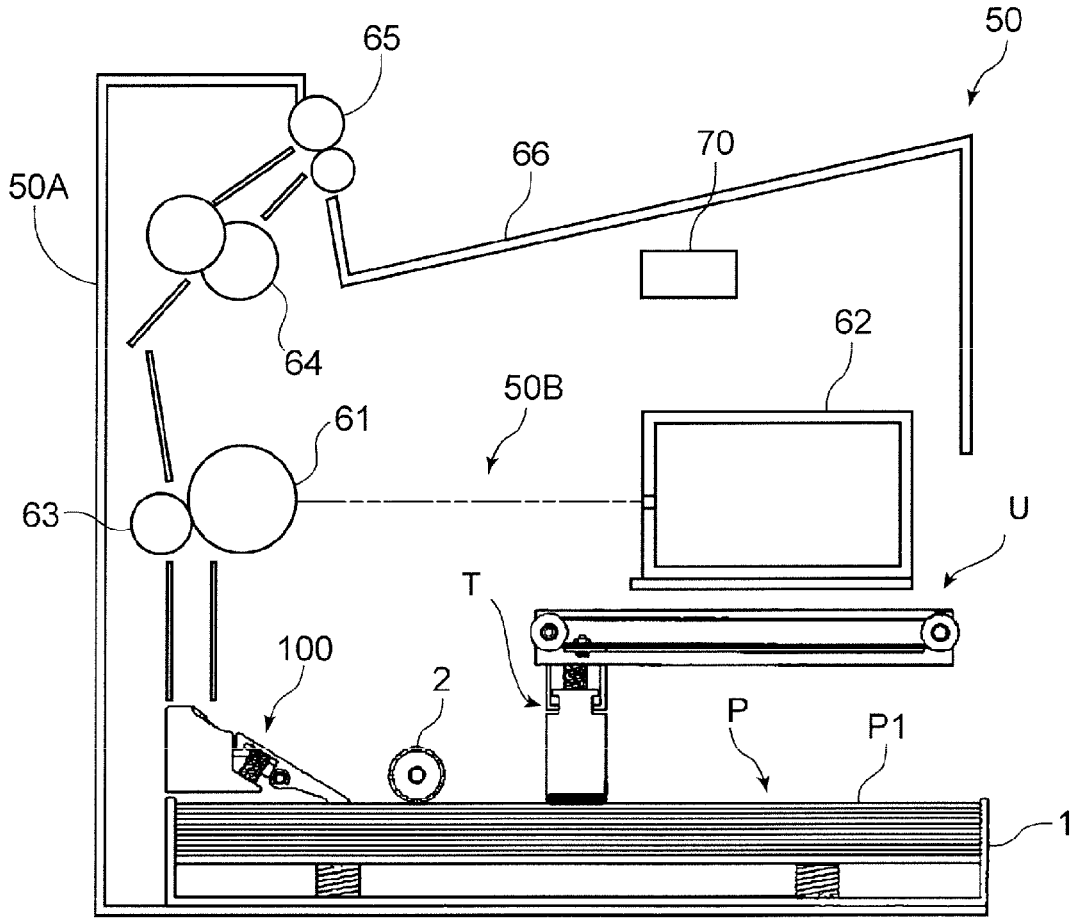
FIG. 1 is a view illustrating a schematic structure of an image forming apparatus including a sheet feeding apparatus according to a first embodiment of the present invention.

In the following, embodiments of the present invention will be described in detail with reference to the drawings. FIG. 1 is a view illustrating a schematic structure of an image forming apparatus including a sheet feeding apparatus according to the first embodiment of the present invention. An image forming apparatus 50 is provided with an image forming apparatus body 50A, an image forming portion 50B, and a sheet feeding apparatus 100 which feeds sheets P such as recording paper to the image forming portion 50B.

The image forming portion 50B includes a photosensitive drum (an image bearing member) 61, and a laser scanner unit 62 which forms an electrostatic latent image on the photosensitive drum 61 by performing exposure on the surface of the photosensitive drum 61.

The sheet feeding apparatus 100 includes a sheet cassette 1 and a feeding roller 2 being a sheet feeding member which feeds the sheets P stored in the sheet cassette 1 one by one from the uppermost sheet P1. A transfer roller 63 constitutes a transfer portion with the photosensitive drum 61. A pair of fixing rollers 64 is arranged. A CPU 70 is a controlling portion which controls image forming operation of the image forming portion 50B and sheet feeding operation of the sheet feeding apparatus 100.

Next, image forming operation of the image forming apparatus 50 as structured above will be described. When image information is sent from a personal computer (not illustrated) and the CPU 70 which performs an image forming process on the image information transmits a print signal, a latent image is formed on the photosensitive drum 61 with image exposure light from the laser scanner unit 62. Subsequently, the latent image on the photosensitive drum 61 is developed with toner by a development device (not illustrated), so that a toner image is formed on the photosensitive drum 61.

Meanwhile, when the print signal is transmitted from the CPU 70, the feeding roller 2 is rotated and the uppermost sheet P1 stored in the sheet cassette 1 is fed. Then, the uppermost sheet P1 is conveyed to the transfer portion which is constituted with the photosensitive drum 61 and the transfer roller 63. At the transfer portion, the toner image formed on the photosensitive drum 61 is transferred to the sheet P1. Then, the toner image is fixed to the sheet P1 owing to heat and pressure applied by the pair of fixing rollers 64. Subsequently, the sheet P1 on which the image is fixed is discharged by a pair of discharge rollers 65 to a stack tray 66 placed at an upper face of the image forming apparatus body 50A.

Here, as illustrated in FIG. 2, the sheet cassette 1 includes a bottom plate 5 being a sheet support portion on which the sheets P are stacked and a compression spring 6. The bottom plate 5 is applied with a force by the compression spring 6, so that the uppermost sheet P1 of the sheets P stacked on the bottom plate 5 is pressed to the feeding roller 2. The feeding roller 2 is configured to be rotatable in a forward rotation direction indicated by arrow R to feed the sheet P and in a reverse rotation direction indicated by arrow L to convey the sheet P in the opposite direction (hereinafter, called the drawing direction) to the sheet feeding direction.

Here, the sheet feeding apparatus 100 includes a sheet holding portion T which is disposed to the downstream in the drawing direction of the feeding roller 2 being capable of performing forward and reverse rotation and which distorts the sheet P as restricting movement of the sheet P in the drawing direction due to the reverse rotation of the feeding roller 2. The sheet holding portion T includes a friction piece 3 which abuts to the upper face of the sheet P, a friction piece support member 7 which supports the friction piece 3, and a friction piece holder 8. The friction piece 3 is attached to a lower face of the friction piece support member 7 which is arranged at the inside of the friction piece holder 8 being capable of being lifted and lowered and to which a force is applied downward by a compression spring 9. Since the friction piece support member 7 is applied with the force downward by the compression spring 9, the sheets P stacked on the sheet cassette 1 are pressed by the friction piece 3.

The sheet holding portion T is arranged as being movable along the sheet feeding direction with a moving mechanism U which is placed above the sheet cassette 1. The moving mechanism U includes a rail 10 arranged as being extended in the sheet feeding direction, and a timing belt 12 which is looped between a driven pulley 14 disposed to a shaft attached to the rail 10 and a drive pulley 11 disposed to a drive shaft 13 attached to the rail 10. Further, the moving mechanism U includes a friction piece moving motor M2 which is a drive source to perform transmission to the drive shaft 13 (see FIG. 4). Here, the sheet holding portion T is attached to the timing belt 12 with a screw 15 or by welding. With this structure, when the timing belt 12 is rotated, the sheet holding portion T is moved along the sheet feeding direction.

Figure 2A:
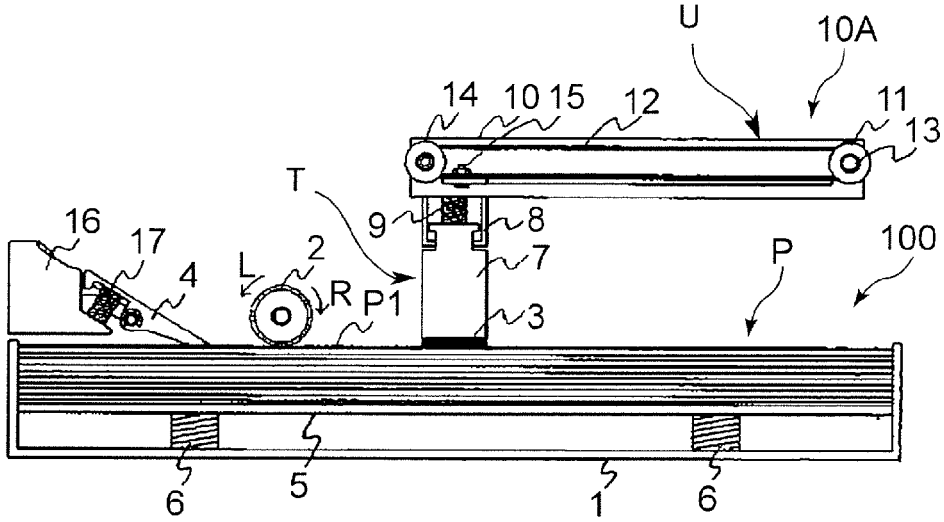
FIGS. 2A and 2B are explanatory views of a structure of the sheet feeding apparatus.
Figure 2B:
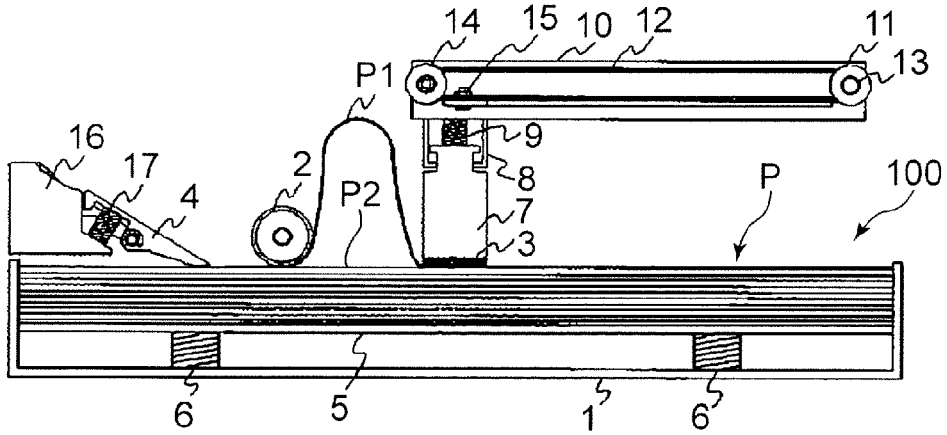
Figure 3A:
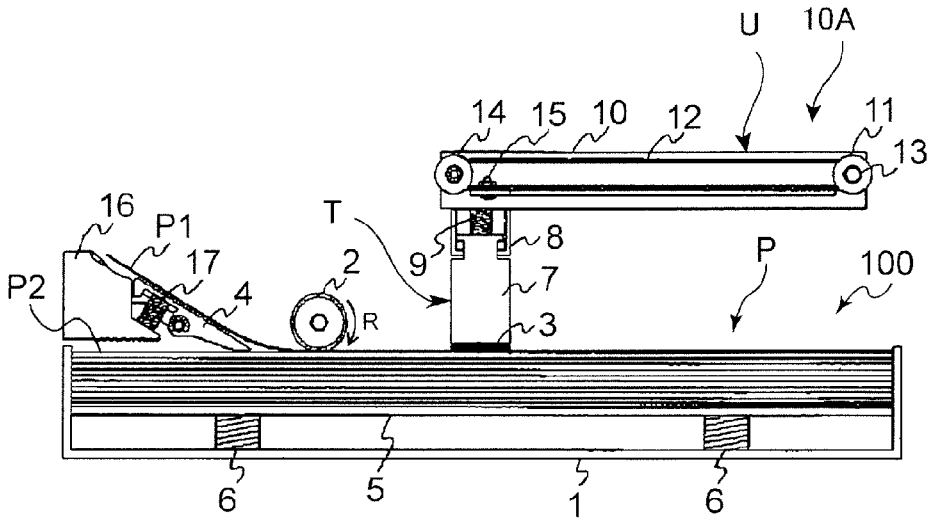
FIGS. 3A and 3B are explanatory views for sheet feeding operation of the sheet feeding apparatus.
Figure 3B:
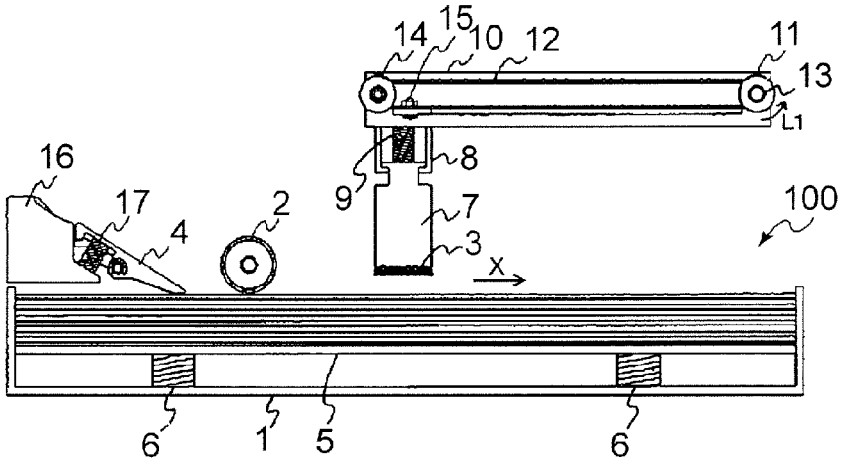

Further, according to a cam mechanism (not illustrated), the rail 10 is arranged to be movable between two positions, that is, a first position (i.e., a holding position) at which the friction piece 3 presses sheets as illustrated in FIG. 2 and a second position (i.e., a separated position) at which the friction piece 3 is separated from the stacked sheets as illustrated in FIG. 3B. That is, the sheet holding portion T is moved between the holding position and the separated position owing to a lifting and lowering portion 10A which is constituted with the rail 10 and the cam mechanism (not illustrated).

Further, the sheet feeding apparatus 100 includes a separation claw 4 which normally presses, from the upper side, a downstream end part of the sheets P stored in the sheet cassette 1 in the sheet feeding direction and which separates the sheets P as the uppermost sheet P1 passes on the upper face of the separation claw 4 as described below at the time of sheet feeding. As illustrated in FIG. 2, the separation claw 4 positions at the downstream from the feeding roller 2 in the sheet feeding direction and holds the sheets P from the upper side with a compression spring 17 attached to a separation claw support base 16 which is placed above the stacked sheets P. Here, in the present embodiment, sheet material such as a PET sheet is stuck to the upper face of a top end of the separation claw 4 to smoothen the sheet running onto the separation claw 4 when the uppermost sheet P1 passes on the upper face of the separation claw 4 as described below.

Next, description will be performed on sheet feeding operation of the sheet feeding apparatus 100 having the above structure.

At the time of sheet feeding, first, the CPU 70 causes the feeding roller 2 to perform reverse rotation in the direction of arrow L indicated in FIG. 2A until a front end of the sheet P gets through the top end the separation claw 4. In the present embodiment, the amount of the reverse rotation of the feeding roller 2 is controlled by a timer mounted on the CPU 70. Here, it is also possible to control the rotation amount by utilizing a sensor.

When the feeding roller 2 performs reverse rotation as described above, the uppermost sheet P1 is moved in the drawing direction. Here, since the friction piece 3 is located to press the sheets P, conveyance of the uppermost sheet P1 in the drawing direction is restricted by the friction piece 3 and distortion occurs between the feeding roller 2 and the friction piece 3, as illustrated in FIG. 2B. Here, when the feeding roller 2 performs reverse rotation, there is a possibility of occurrence of conveyance and distortion of at least the second sheet P2 positioned below the uppermost sheet P1 to be caused by a friction force with the uppermost sheet P1.

However, since at least the second sheet P2 has a restoring force to restore from the distorted state being larger than the force in the drawing direction received from the feeding roller 2 via the uppermost sheet P1, the front end of the sheet P2 does not get through the top end of the separation claw 4. Accordingly, when the feeding roller 2 performs reverse rotation, the uppermost sheet P1 and the second sheet P2 are separated.

Next, when the front end of the uppermost sheet P1 gets through the top end of the separation claw 4, the feeding roller 2 performs forward rotation in the direction of arrow R and sheet feeding is started, as illustrated in FIG. 3A. At that time, since the top end of the separation claw 4 is in a state of pressing the second sheet P2, the uppermost sheet P1 is conveyed while running on the separation claw 4. After the uppermost sheet P1 runs on the separation claw 4 as described above, the rail 10 is switched to the second position as illustrated in FIG. 3B to be separated from the uppermost sheet P1 so as not to cause a burden for sheet feeding. In this manner, the uppermost sheet P1 is stably fed along the upper face of the separation claw 4.

As described above, when a sheet is conveyed once in the drawing direction, the second sheet P2 is also moved in the drawing direction along with the uppermost sheet P1. When the sheet is distorted as being turned in the drawing direction, the restoring force to restore from the distorted state occurs at the sheets P1, P2. Here, the restoring force varies greatly depending on a type of sheet, especially on basis weight. For example, in general, thickness of a sheet becomes large causing increased stiffness (i.e., rigidity) with increase of basis weight of the sheet (i.e., a heavy sheet) and thickness of a sheet becomes small causing decreased stiffness (i.e. rigidity) with decrease of basis weight (i.e., a light sheet) as for sheets to be used normally. Accordingly, in a case of sheets of thin paper, the restoring force is smaller than that of plain paper owing to low stiffness (i.e., low rigidity).

Incidentally, there is a case that the friction force between the uppermost sheet P1 and the second sheet P2 is relatively large and the restoring force of the second sheet is smaller than the friction force between the sheets. In this case, the second sheet P2 which is normally supposed to be restored by the restoring force is distorted without being restored with the restoring force as a result of low stiffness, and subsequently, the front end thereof gets through the top end of the separation claw 4. Then, when the feeding roller 2 performs forward rotation in the sheet feeding direction in this state, the second sheet P2 is fed along with the uppermost sheet P1, resulting in double-feeding.

On the other hand, in general, in a case of sheets of thick paper, stiffness is high (i.e., the rigidity is high) and distortion is unlikely to occur. Accordingly, in a case that the force of the feeding roller 2 for feeding the uppermost sheet in the opposite direction is smaller than the restoring force of the uppermost sheet, the feeding roller 2 slips on the sheet. In such a case, the front end of the uppermost sheet P1 cannot get through the separation claw 4, so that sheet non-feeding occurs.

Thus, in a condition with the same pressing force, double-feeding is more likely to occur in a case of sheets of thin paper having smaller stiffness and a smaller restoring force as the basis weight being smaller than that of plain paper (generally, the basis weight being between 60 and 90 g/m$^2$). Meanwhile, non-feeding is more likely to occur owing to slipping of the feeding roller caused by shortage of a conveying force thereof with less distortion in a case of sheets of thick paper having larger basis weight, larger stiffness and a larger restoring force than those of plain paper. Therefore, in the present embodiment, the position of the friction piece 3 is variably arranged and the position of the friction piece 3 is to be varied according to the type of sheet (i.e. the stiffness thereof) as variably arranging so as to prevent double-feeding and non-feeding. Here, as described above, in general, magnitude of sheet stiffness can be calculated (i.e., estimated) from sheet basis weight as for sheets to be used normally.

Figure 4:
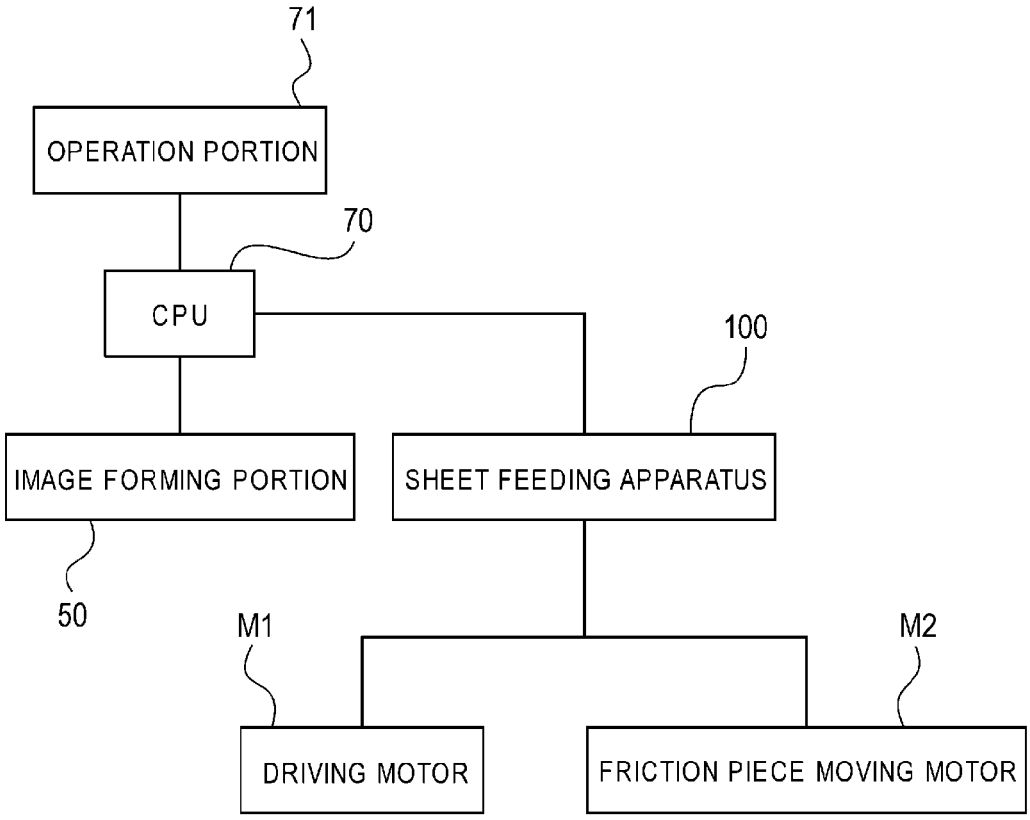
FIG. 4 is a control block diagram of the image forming apparatus.

FIG. 4 is a control block diagram of the image forming apparatus 50 including the sheet feeding apparatus 100 in which the position of the friction piece 3 is varied according to the type of sheet as described above. In FIG. 4, an operation portion 71 being an input portion inputs information such as sheet basis weight for stiffness information to the CPU 70. A driving motor M1 capable of performing forward and reverse rotation rotates the feeding roller 2 in forward and reverse directions and a friction piece moving motor M2 moves the friction piece 3 by rotating the timing belt 12. Based on the information such as the sheet basis weight input from the operation portion 71, the CPU 70 rotates the timing belt 12 by rotating the friction piece moving motor M2 according to the type of sheet (i.e., sheet stiffness) and moves the friction piece 3 to the position corresponding to the type of sheet.

For example, in a case of sheets of thin paper, the CPU 70 being the controlling portion which controls the pressing position of the sheets P with the sheet holding portion T sets the position of the friction piece 3 (i.e., the friction piece holder 8) at the position being close to the feeding roller 2 as illustrated in FIGS. 2 and 3. As illustrated in FIG. 2B, the deformation amount (i.e., the distortion amount) of the uppermost sheet P1 can be enlarged by pressing the sheets with the sheet holding portion T which is set at the above-mentioned position. Then, the restoring force of the second sheet P2 can be enlarged by enlarging the deformation amount of the uppermost sheet P1 as described above, so that double-feeding can be prevented.

Figure 5A:
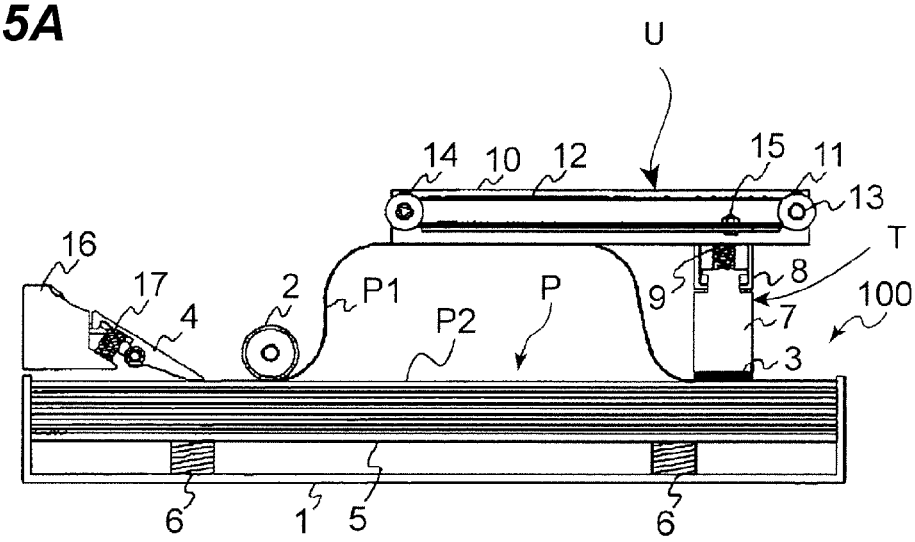
FIGS. 5A and 5B are explanatory views for the sheet feeding operation of the sheet feeding apparatus in a case of sheets of thick paper.
Figure 5B:
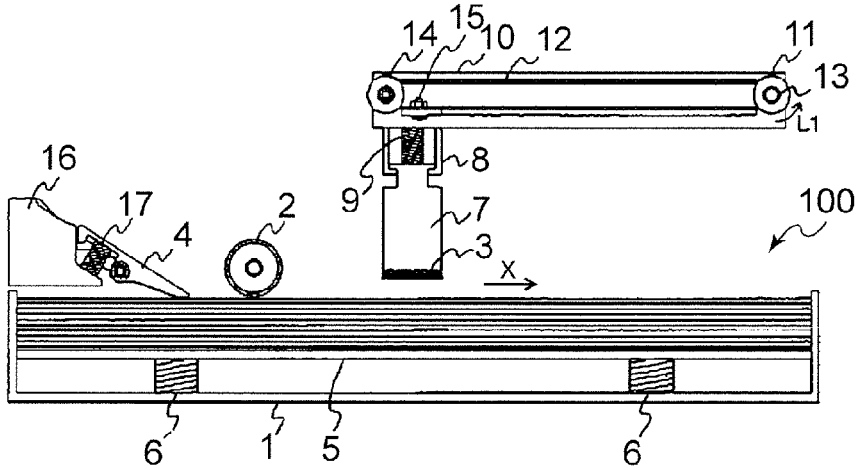

In contrast, in a case of sheets of thick paper, the position of the sheet holding portion T is set to be the position being apart from the feeding roller 2, as illustrated FIG. 5. The uppermost sheet P1 having the large restoring force can be gently distorted as illustrated in FIG. 5A by pressing the sheets with the sheet holding portion T which is set at the above-mentioned position. Accordingly, non-feeding of the uppermost sheet P1 can be prevented.

Figure 6:
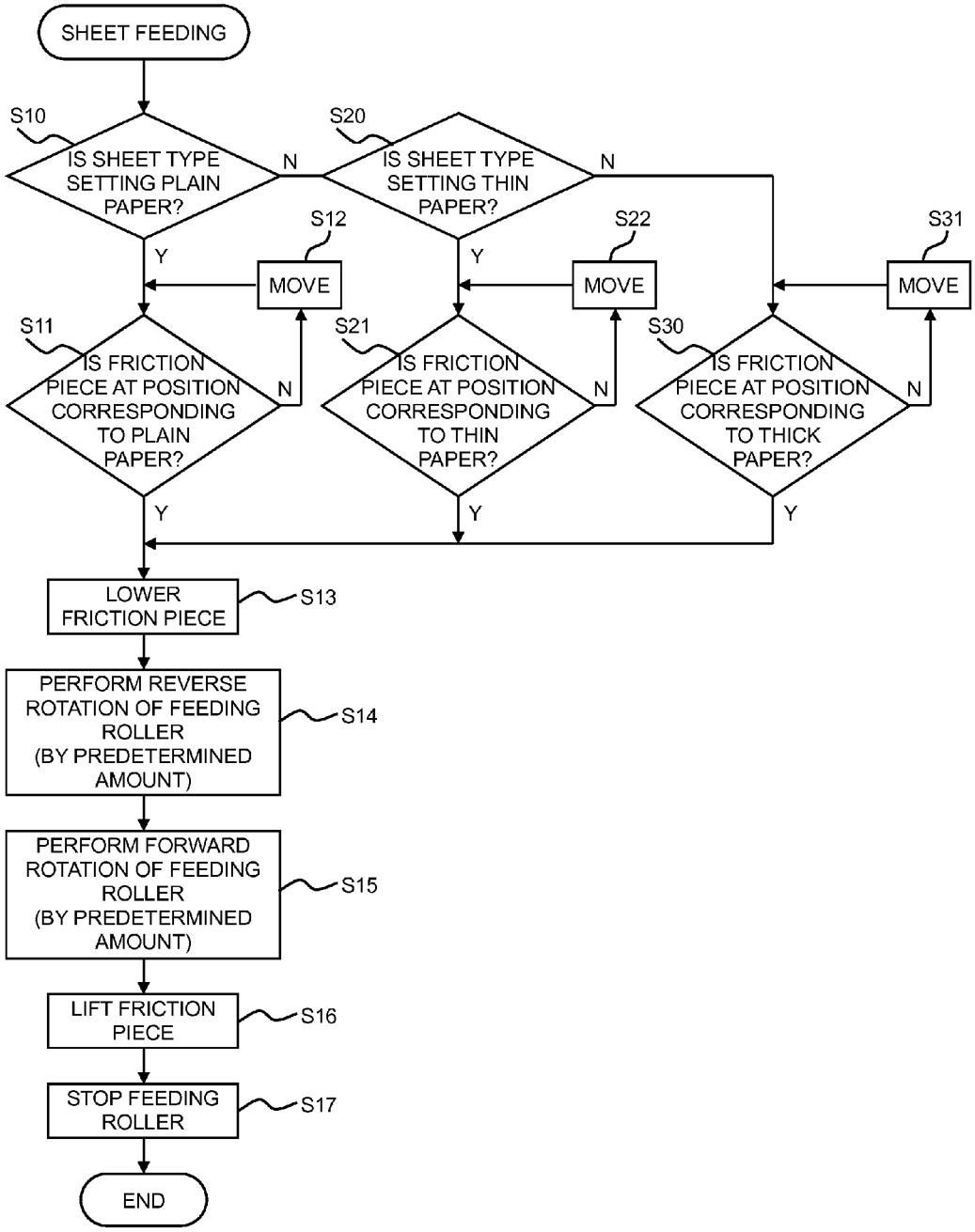
FIG. 6 is a flowchart describing position control of a friction piece and sheet feeding operation control due to a CPU which is arranged in the image forming apparatus.

Next, the position control of the sheet holding portion T and the sheet feeding operation control due to the CPU 70 will be described with reference to a flowchart of FIG. 6. First, a user inputs the type of sheet (i.e., thin paper, plain paper or thick paper) at the operation portion 71. When the sheet feeding operation is started, the CPU 70 determines whether the sheet type setting is plain paper based on the input information (S10). Here, the rail 10 and the sheet holding portion T stay at the second position as being separated from the sheets until the sheet feeding operation is started.

When the sheet type setting is plain paper ("Y" in S10), it is determined whether the sheet holding portion T is at the position corresponding to plain paper (S11). When the sheet holding portion T is not at the position corresponding to plain paper ("N" in S11), the CPU 70 rotates the friction piece moving motor M2 by a predetermined amount. Then, the rotation of the friction piece moving motor M2 is transmitted from the drive shaft 13 to the timing belt 12 via the drive pulley 11, so that the friction piece 3 is moved to the position corresponding to plain paper integrally with the friction piece holder 8 (S12). Here, the position corresponding to plain paper is a predetermined position between the position corresponding to thin paper as illustrated in FIG. 2A and the position corresponding to thick paper as illustrated in FIG. 5A.

Next, when the sheet holding portion T is moved to the position corresponding to plain paper, the rail 10 is moved from the second position to the first position by the cam mechanism (not illustrated) and the sheet holding portion T is lowered (S13). Accordingly, the friction piece 3 of the sheet holding portion T is pressed to the sheets. Next, the feeding roller 2 is rotated in the reverse direction by a predetermined amount by rotating the drive motor M1 in the reverse direction (S14), so that a sheet is drawn. Subsequently, the feeding roller 2 is rotated in the forward direction by a predetermined amount by rotating the drive motor M1 in the forward direction (S15), so that the drawn sheet is fed. When the sheet feeding is completed, the rail 10 is moved from the first position to the second position by the cam mechanism (not illustrated), so that the sheet holding portion T is lifted (S16). Subsequently, the drive motor M1 is stopped and the feeding roller 2 is stopped (S17).

In contrast, when the sheet type setting is not plain paper ("N" in S10), the CPU 70 determines whether the sheet type setting is thin paper (S20). In a case of thin paper ("Y" in S20), it is determined whether the sheet holding portion T is at the position corresponding to thin paper (S21). When the sheet holding portion T is not at the position corresponding to thin paper ("N" in S21), the CPU 70 rotates the friction piece moving motor M2 by a predetermined amount and the sheet holding portion T is moved to the position corresponding to thin paper as illustrated in FIG. 2 (S22). Subsequently, the above-mentioned processes S13 to S17 are performed.

Alternatively, when the sheet type setting is not plain paper nor thin paper ("N" in S20), the CPU 70 determines that the sheets is thick paper and determines whether the sheet holding portion T is at the position corresponding to thick paper (S30). When the sheet holding portion T is not at the position corresponding to the thick paper ("N" in S30), the CPU 70 rotates the friction piece moving motor M2 by a predetermined amount and the sheet holding portion T is moved to the position corresponding to thick paper as illustrated in FIG. 5A (S31). Subsequently, the above-mentioned processes S13 to S17 are performed.

As described above, in the present embodiment, in a case of sheets of thin paper having low stiffness, the sheet holding portion T is moved to the position being close to the feeding roller 2 as illustrated in FIG. 2A. Alternatively, in a case of sheets of thick paper having high stiffness, the sheet holding portion T is moved to the position of FIG. 5A being further apart from the feeding roller 2 than the position of FIG. 2A. That is, in the present embodiment, the position of the sheet holding portion T is set to be closer to the feeding roller 2 with decrease of sheet stiffness. Since the position of the sheet holding portion T is set to be closer to the feeding roller 2 with decrease of sheet stiffness, stable sheet feeding can be performed without occurrence of double-feeding and non-feeding regardless of a type of sheet.

Next, a second embodiment of the present invention will be described. FIG. 7 is a view illustrating a structure of a sheet feeding apparatus 100 according to the present embodiment. Here, in FIG. 7, the same numeral as that in FIG. 2 which is described above denotes the same or similar portion.

In FIG. 7, sheet holding portions T1 to T3 respectively distort a sheet by restricting movement of the sheet drawn with reverse rotation of the feeding roller 2. The sheet holding portions T1 to T3 respectively include friction pieces 3A to 3C plurally arranged along the sheet feeding direction, friction piece support members 7A to 7C which support the friction pieces 3A to 3C, and friction piece holders 8A to 8C which hold the friction piece support members 7A to 7C as being capable of being lifted and lowered at the inside thereof. Further, the friction piece support members 7A to 7C are applied respectively with forces downward in the friction piece holders 8A to 8C by compression springs 9A to 9C. Since the friction pieces 3A to 3C are attached respectively at bottom faces of the friction piece support members 7A to 7C and the friction piece support members 7A to 7C are applied respectively with the forces by the compression springs 9A to 9C, the friction pieces 3A to 3C are to be pressed to the sheets P stacked on the sheet cassette 1.

Here, in the present embodiment, only one sheet holding portion out of the three sheet holding portions T1 to T3 is pressed to the uppermost sheet according to the type of sheet and the rest of the sheet holding portions are retracted to positions above the sheets.

Figure 7A:
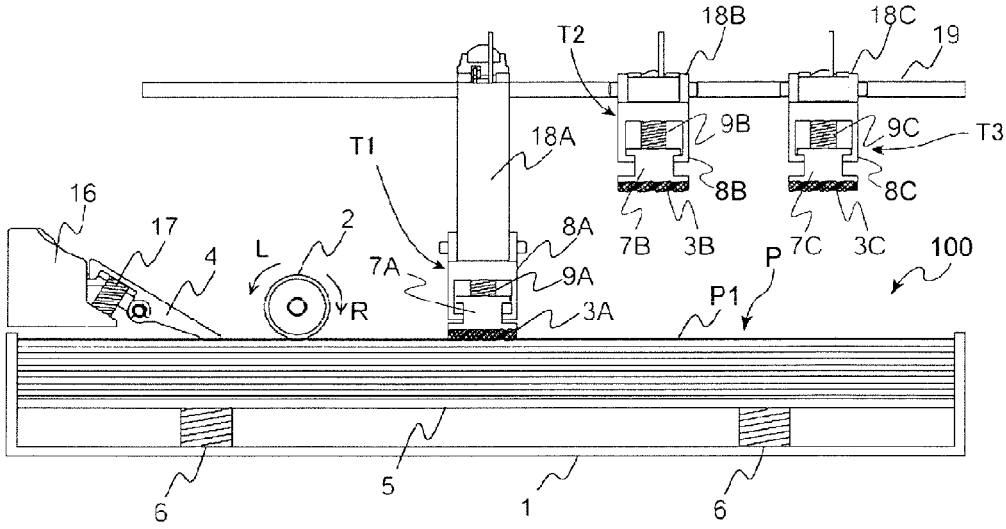
FIGS. 7A and 7B are explanatory views of a structure of a sheet feeding apparatus according to a second embodiment of the present invention.
Figure 7B:
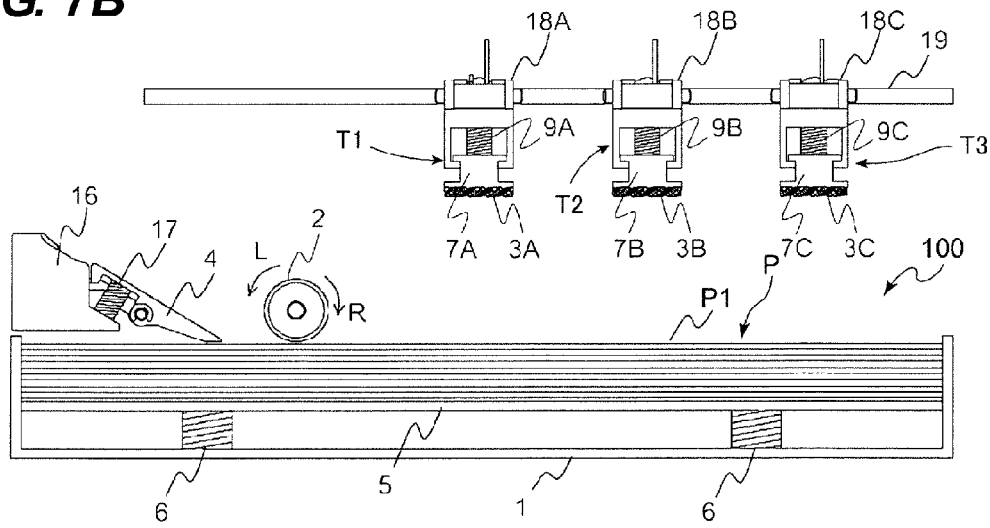

FIG. 7A illustrates a state of the sheet feeding apparatus 100 in a case of sheets of thin paper.

In this case, since a plate-shaped member 18A being closest to the feeding roller 2 is swung about a shaft 19, the sheet holding portion T1 is lowered and the friction piece 3A is pressed to the sheets P owing to the compression spring 9A. At that time, the other friction pieces 3B, 3C and the friction piece holders 8B, 8C are retracted to positions above the sheets.

Then, similarly to the first embodiment as described above, by performing reverse rotation and forward rotation of the feeding roller 2 in the above state, the uppermost sheet P1 is fed. When the fed uppermost sheet P1 passes on the upper face of the separation claw 4, the sheet holding portion T1 is lifted as illustrated FIG. 7B and the friction piece 3A is separated from the sheets P. In this manner, the uppermost sheet P1 can be stably fed.

Similarly, in a case of sheets of plain paper, the sheet holding portion T2 between the sheet holding portion T1 being closest to the feeding roller 2 and the sheet holding portion T3 being farthest from the feeding roller 2 is pressed to the sheets. Alternatively, in a case of sheets of thick paper, the sheet holding portion T3 is pressed to the sheets. Here, although three of the sheet holding portions T1 to T3 are arranged in the present embodiment, it is also possible to arrange less sheet holding portions. On the contrary, it is also possible to arrange more sheet holding portions so as to perform fine management against a type of sheet.

Figure 8:
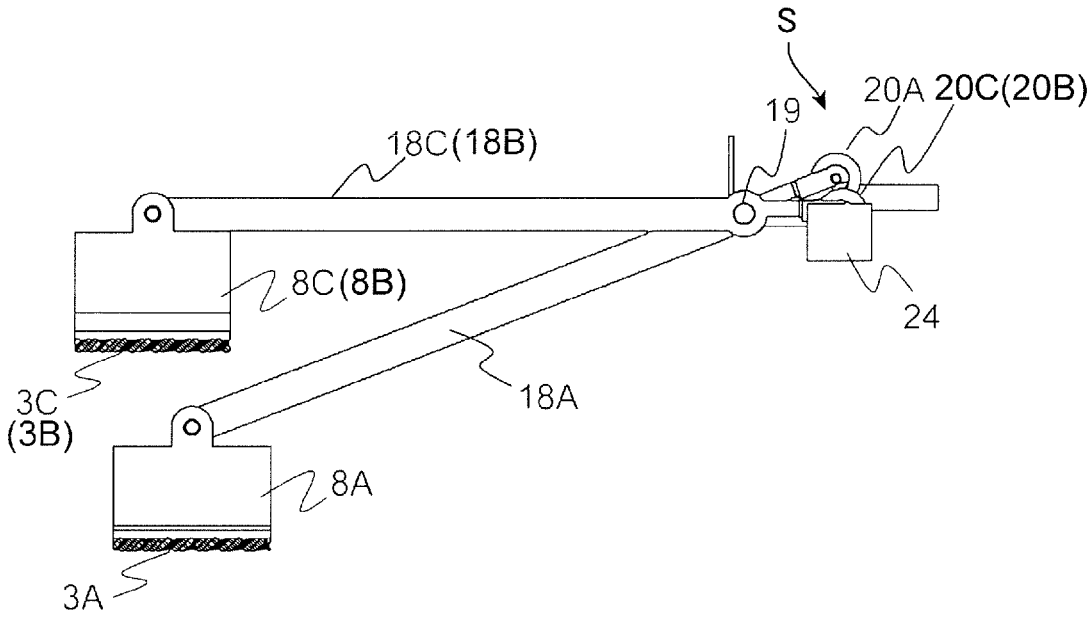
FIG. 8 is an explanatory view of a structure of a friction piece holder arranged at the sheet feeding apparatus.

Next, a swinging mechanism S to vertically swing (i.e., to lift and lower) the three sheet holding portions T1 to T3 selectively according to a type of sheet will be described with reference to FIGS. 8 and 9. As illustrated in FIG. 8, plate-shaped members 18A to 18C are swingably supported at predetermined intervals by the shaft 19 extended in the sheet feeding direction. The friction piece holders 8A to 8C are rotatably held respectively at one swing end of the plate-shaped members 18A to 18C. The friction pieces 3A to 3C can be moved respectively between a position of pressing sheets and a position of being separated from the sheets via the friction piece holders 8A to 8C by vertically swinging the plate-shaped members 18A to 18C about the shaft 19.

Figure 9:
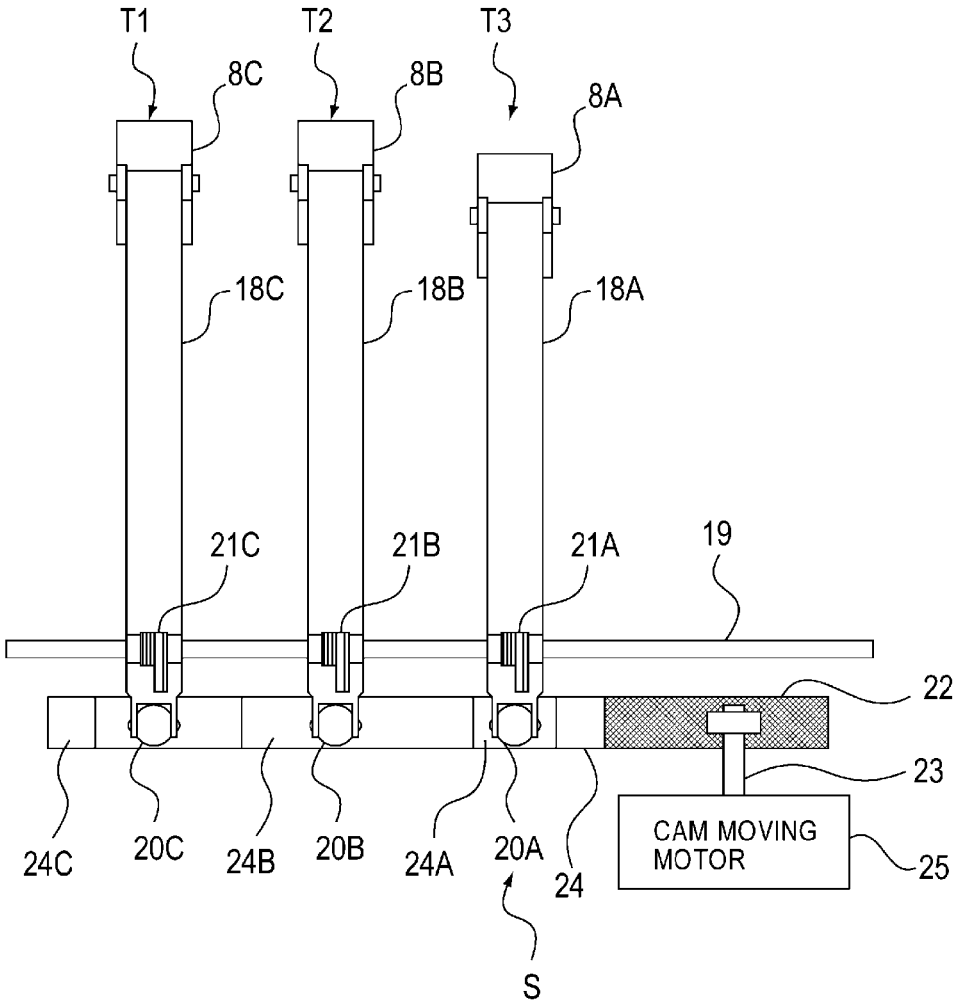
FIG. 9 is an explanatory view of a swinging mechanism of the friction piece holder.

Further, as illustrated in FIG. 9, the friction piece holders 8A to 8C are arranged respectively at the one end of the plate-shaped members 18A to 18C and rollers 20A to 20C are arranged respectively at the other end thereof as being rotatable owing to respective shaft portions (not illustrated). Further, the plate-shaped members 18A to 18C are applied respectively with forces by the torsion coil springs 21A to 21C which are attached around the shaft 19 so that the rollers 20A to 20C are pressure-contacted to a cam 24.

Here, the cam 24 includes projecting portions 24A to 24C which selectively push up the rollers 20A to 20C of the plate-shaped members 18A to 18C and a rack portion 24R which is disposed to one end part thereof, as illustrated in FIG. 10. As illustrated in FIG. 9, the rack portion 24R of the cam 24 is engaged with a pinion 22 which is driven by a cam moving motor 25 capable of performing forward and reverse rotation. When the pinion 22 is rotated by driving the cam moving motor 25, the cam 24 is horizontally moved accordingly. In FIG. 10, all of the sheet holding portions T1 to T3 are retracted upward with the cam 24 (i.e., the projecting portions 24A to 24C thereof) being at position P0 and the sheet holding portion T1 is pressed to the sheets with the cam 24 being at a position P1. Further, the sheet holding portion T2 is pressed to the sheets with the cam 24 being at a position P2 and only the sheet holding portion T3 is pressed to the sheets with the cam 24 being at a position P3.

Figure 10A:
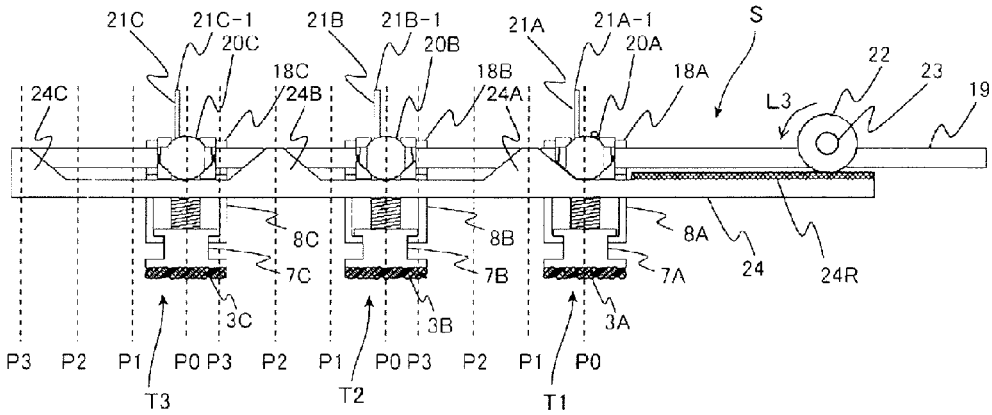
FIGS. 10A and 10B are explanatory views for operation of the swinging mechanism of the friction piece holder.
Figure 10B:
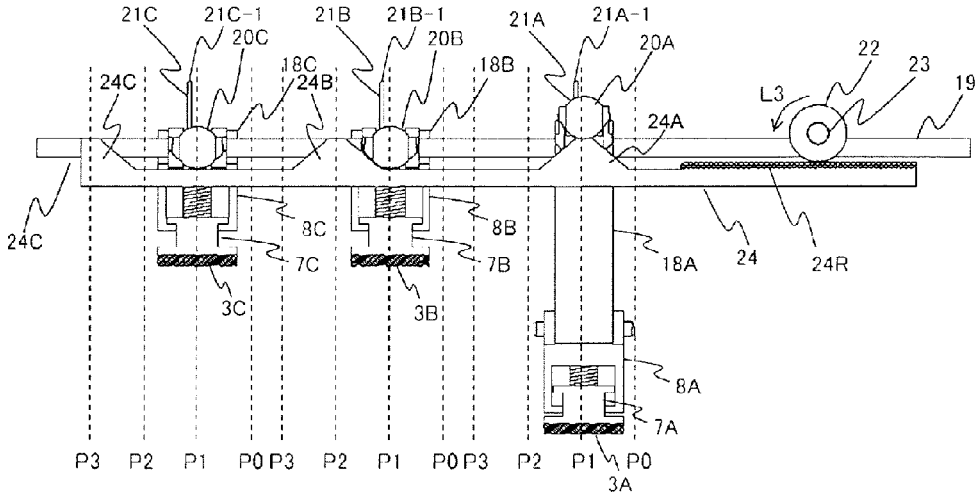

Next, selective swinging operation of the sheet holding portions T1 to T3 with the swinging mechanism S will be described. In a case of sheets of thin paper, the pinion 22 is rotated by driving the cam moving motor 25 from a state that all of the sheet holding portions T1 to T3 are retracted upward as illustrated in FIG. 10A until the cam 24 is moved to a position at which the projecting portion 24A pushes up the roller 20A as illustrated in FIG. 10B. That is, the cam 24 in a state of being at a position P0 as illustrated in FIG. 10A is to be in a state of being at the position P1 by rotating the pinion 22 in the direction of arrow L3 by a predetermined amount. With this operation, the sheets can be pressed by the sheet holding portion T1 according to the sheets of thin paper.

Here, by moving the cam 24 to the position P2 in a case of sheets of plain paper, the sheets can be pressed by the sheet holding portion T2 according to plain paper. Alternatively, by moving the cam 24 to the position P3 in a case of sheets of thick paper, the sheets can be pressed by the sheet holding portion T3 according to thick paper. As described above, in the present embodiment, a lifting and lowering portion which selectively lowers one of the plurality of sheet holding portions T1 to T3 from a separated position to a holding position is structured by a cam mechanism constituted with the cam 24 and the cam moving motor 25.

Figure 11:
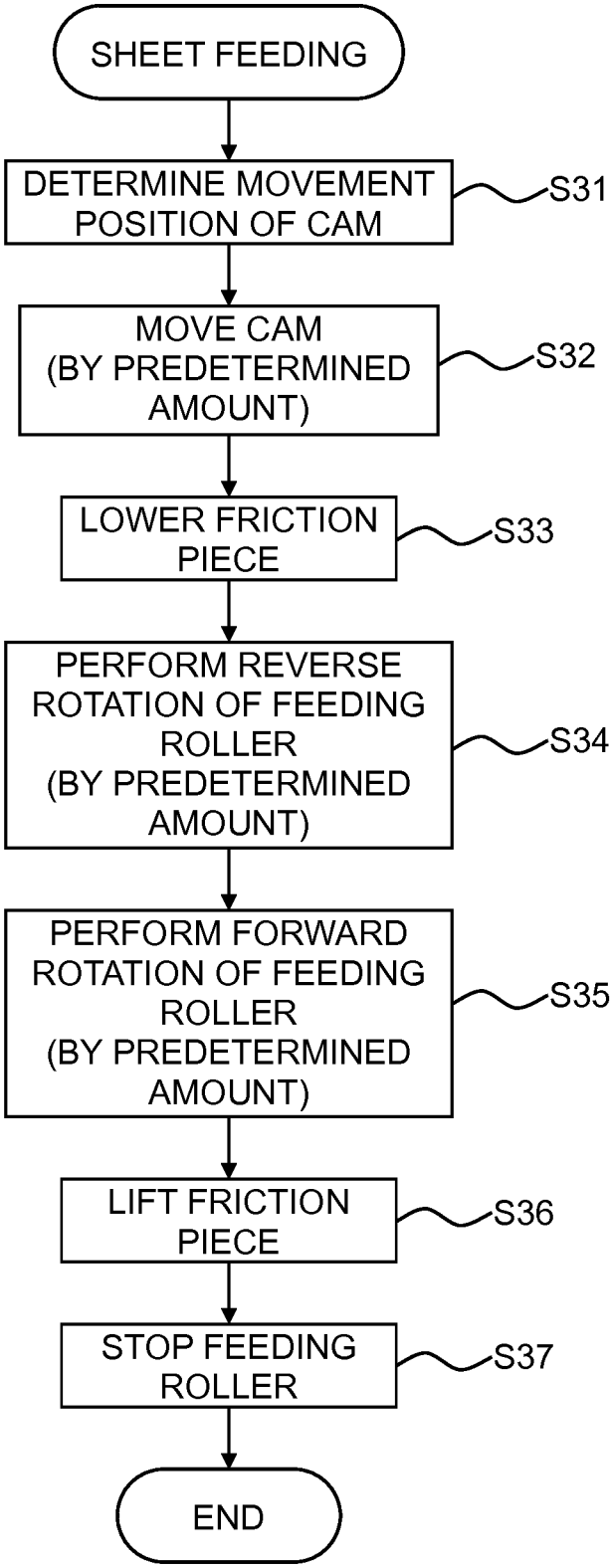
FIG. 11 is a flowchart describing position control of a friction piece and sheet feeding operation control due to a CPU which is arranged in the image forming apparatus.

Next, the position control of the sheet holding portions T1 to T3 and sheet feeding operation control according to the present embodiment will be described with reference to a flowchart of FIG. 11. First a user inputs the type of sheet (i.e., thin paper, plain paper or thick paper) at an operation portion. When sheet feeding operation is started, the CPU 70 determines a movement position of the cam according to the type of sheet based on the input information (S31). Then, the CPU 70 drives the cam moving motor 25. The rotation of the cam moving motor 25 is transmitted to the rack 24R via a drive shaft 23 and the pinion 22, so that the cam 24 is moved to a position corresponding to the type of sheet (S32).

Figure 12A:
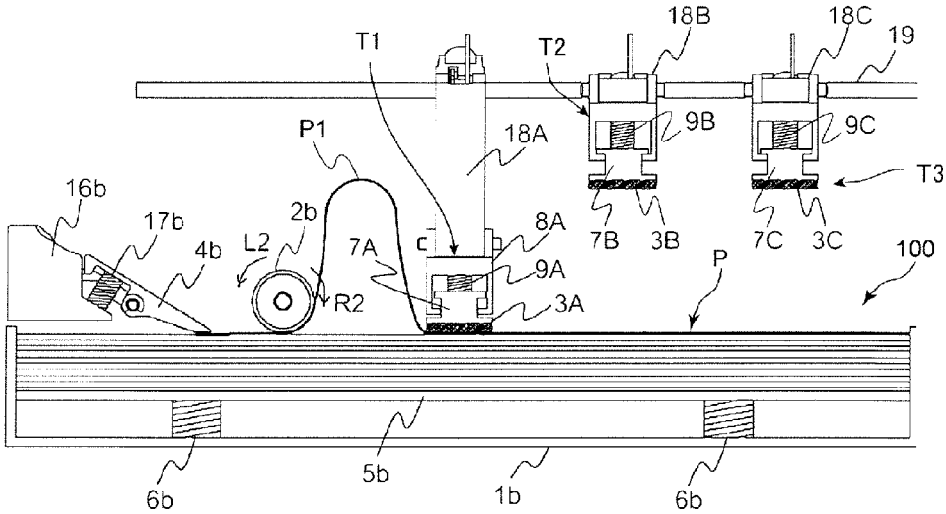
FIGS. 12A and 12B are explanatory views for sheet feeding operation of the sheet feeding apparatus.
Figure 12B:
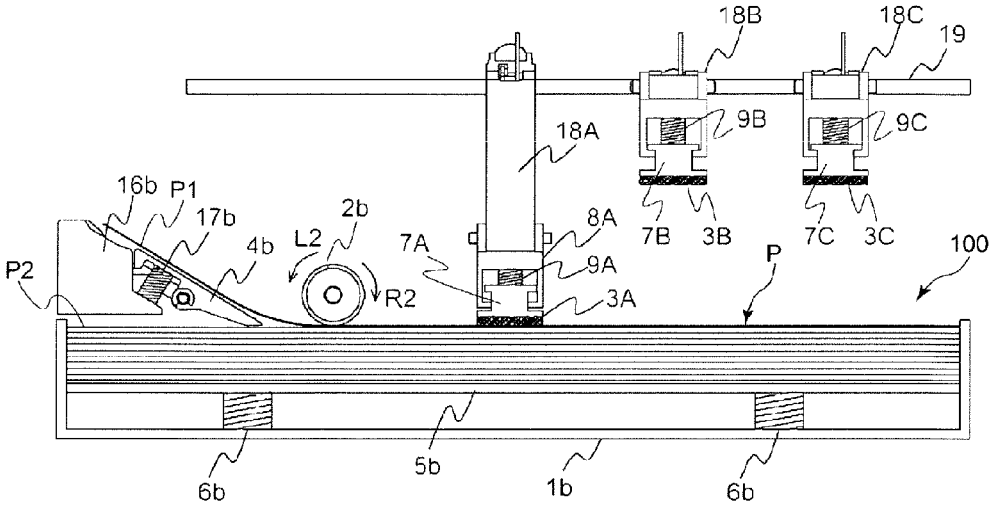

For example, in a case of sheets of thin paper, the cam 24 is moved from the position P0 as illustrated in FIG. 10A to the position P1 as illustrated in FIG. 10B. Accordingly, the plate-shaped member 18A and the sheet holding portion T1 are lowered (S33) as illustrated in FIG. 7A and the friction piece 3A is pressed to the sheets. Then, the feeding roller 2 performs reverse rotation by a predetermined amount (S34), so that large distortion occurs at the uppermost sheet P1 between the feeding roller 2 and the friction piece 3 as illustrated in FIG. 12A. Since the deformation amount of the uppermost sheet P1 is enlarged, the distortion amount of the second sheet P2 can be enlarged. Accordingly, the restoring force of the second sheet P2 can be enlarged, so that double-feeding can be prevented.

Subsequently, when the front end of the uppermost sheet P1 gets through the top end of the separation claw 4, the feeding roller 2 performs forward rotation in the direction of arrow R by a predetermined amount (S35) as illustrated in FIG. 12A. Accordingly, the uppermost sheet P1 is conveyed while running on the separation claw 4. Subsequently, when the sheet feeding is completed, the cam moving motor 25 is rotated in the reverse direction so as to move the cam 24 from the position P1 as illustrated in FIG. 10B to the position P0 as illustrated in FIG. 10A. Owing to the movement of the cam 24 as described above, the plate-shaped member 18A and the sheet holding portion T1 are lifted (S36). Then, the feeding roller 2 is stopped (S37).

As described above, in the present embodiment, in a case of sheets of thin paper having low stiffness, for example, the shaft holding portion T1 being closest to the feeding roller 2 is lowered as illustrated in FIG. 7A. Alternatively, in a case of sheets of thick paper having high stiffness, the sheet holding portion T3 being further apart from the feeding roller 2 than the sheet holding portion T1. That is, in the present embodiment, the sheet holding portion being closer to the feeding roller 2 is to be lowered with decrease of sheet stiffness. Since the position of the sheet holding portion is set to be closer to the feeding roller 2 with decrease of sheet stiffness, stable sheet feeding can be performed without occurrence of double-feeding and non-feeding regardless of a type of sheet.

In the detailed description of the above embodiments, the sheet holding portion is to be automatically moved by utilizing motor driving. However, the present invention can be applied to a structure in which the sheet holding portion is not automatically moved. For example, it is also possible to manually move the sheet holding portion to an appropriate position with a structure that the sheet holding portion is supported as being freely movable in the sheet feeding direction, an operation lever is integrally attached to the sheet holding portion, and the operation lever is moved by a user according to a type of sheet.

Further, in the above description, the information such as sheet basis weight is to be input to the CPU 70 at the operation portion 71. Here, it is also possible to detect sheet thickness, a loop amount and the like with a sensor and to input such information to the CPU 70 as the information relating to sheet stiffness.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-246516, filed Nov. 2, 2010, which is hereby incorporated by reference herein in its entirety.

What is claimed is:

1. A sheet feeding apparatus comprising:

a sheet support portion on which sheets are stacked;

a separation claw which holds an upper portion of a downstream side end of the sheets stacked on the sheet support portion in a sheet feeding direction;

a feeding roller which is capable of performing forward and reverse rotation to feed an uppermost sheet of the sheets stacked on the sheet support portion, an uppermost sheet is drawn from the separation claw with reverse rotation of the feeding roller and the drawn sheet is fed along the upper face of the separation claw with forward rotation of the feeding roller;

a sheet holding portion which is moved along a sheet drawing direction of the feeding roller at a downstream in the sheet drawing direction of the feeding roller, and the sheet holding portion presses the upper face of the sheets stacked on the sheet support portion to distort the uppermost sheet at a position between the feeding roller and the sheet holding portion by restricting movement of the sheet during drawing the uppermost sheet from the separation claw by the reverse rotation of the feeding roller, and a sheet holding position of the sheet holding portion is set to be closer to the feeding roller with decrease of stiffness of the sheets to be fed.

2. The sheet feeding apparatus according to claim 1, further comprising:

a moving mechanism which moves the sheet holding portion in a sheet feeding direction;

an input portion which inputs sheet stiffness information; and a controlling portion which varies the holding position by moving the sheet holding portion with the moving mechanism based on the stiffness information from the input portion.

3. The sheet feeding apparatus according to claim 2, further comprising a lifting and lowering portion which moves the sheet holding portion between the holding position of holding the sheets and a separated position of being separated from the sheets, wherein the controlling portion controls the moving mechanism and the lifting and lowering portion so as to move the sheet holding portion being at the separated position to the holding position after moving to a position corresponding to the sheet stiffness based on the stiffness information from the input portion.

4. The sheet feeding apparatus according to claim 3, wherein the lifting and lowering portion moves the sheet holding portion between the holding position of holding the sheets and separated position by lifting and lowering the moving mechanism.

5. An image forming apparatus comprising:

a sheet feeding apparatus feeds the sheet to an image forming portion which is formed an image to the sheet, the sheet feeding apparatus comprising;

a sheet support portion on which sheets are stacked;

a separation claw which holds an upper portion of a downstream side end of the sheets stacked on the sheet support portion in a sheet feeding direction;

a feeding roller which is capable of performing forward and reverse rotation to feed an uppermost sheet of the sheets stacked on the sheet support portion, an uppermost sheet is drawn from the separation claw with reverse rotation of the feeding roller and the drawn sheet is fed along the upper face of the separation claw with forward rotation of the feeding roller;

a sheet holding portion which is moved along a sheet drawing direction of the feeding roller at a downstream in the sheet drawing direction of the feeding roller, and the sheet holding portion presses the upper face of the sheets stacked on the sheet support portion to distort the uppermost sheet at a position between the feeding roller and the sheet holding portion by restricting movement of the sheet during drawing the uppermost sheet from the separation claw by the reverse rotation of the feeding roller, and a sheet holding position of the sheet holding portion is set to be closer to the feeding roller with decrease of stiffness of the sheets to be fed.

6. The image forming apparatus according to claim 5, further comprising:

a moving mechanism which moves the sheet holding portion in a sheet feeding direction;

an input portion which inputs sheet stiffness information; and a controlling portion which varies the holding position by moving the sheet holding portion with the moving mechanism based on the stiffness information from the input portion.

7. The image forming apparatus according to claim 6, further comprising a lifting and lowering portion which moves the sheet holding portion between the holding position of holding the sheets and a separated position of being separated from the sheets, wherein the controlling portion controls the moving mechanism and the lifting and lowering portion so as to move the sheet holding portion being at the separated position to the holding position after moving to a position corresponding to the sheet stiffness based on the stiffness information from the input portion.

8. The image forming apparatus according to claim 7, wherein the lifting and lowering portion moves the sheet holding portion between the holding position of holding the sheets and separated position by lifting and lowering the moving mechanism.

* * * * *